US005787556A

United States Patent [19]

Terzian

[11] Patent Number: 5,787,556

[45] Date of Patent: Aug. 4, 1998

[54] STRAP TAKE-UP DEVICE FOR A FASHION ACCESSORY

[75] Inventor: Martin Terzian, Corona, Calif.

[73] Assignee: Pacific Connections of California, Inc., Corona, Calif.

[21] Appl. No.: 818,035

[22] Filed: Mar. 14, 1997

[51] Int. Cl.[6] ..... A41F 1/00; A44B 17/00

[52] U.S. Cl. ..... 24/545; 24/3.12; 24/562; 24/563

[58] Field of Search ..... 24/545, 563, 562, 24/67.9, 555, 547, 546, 336, 338, 318, 3.11, 3.12, 500

[56] References Cited

U.S. PATENT DOCUMENTS

| | | | |
|---|---|---|---|
| 1,520,739 | 12/1924 | Retlitz | 24/563 |
| 1,654,076 | 12/1927 | Griffiths | 24/562 |
| 1,770,914 | 7/1930 | Diven | 24/3.12 |
| 1,924,132 | 8/1933 | Santsaver | 24/545 |
| 2,095,340 | 10/1937 | Meyer . | |
| 2,099,199 | 11/1937 | Devendor et al. . | |
| 2,212,862 | 8/1940 | Hirsh . | |
| 2,278,153 | 3/1942 | Shaulson . | |
| 2,293,562 | 8/1942 | Rosenthal . | |
| 2,545,599 | 3/1951 | Bartlett | 24/336 |
| 3,177,541 | 4/1965 | Derrickson . | |
| 3,218,686 | 11/1965 | Rubenstein . | |
| 3,222,688 | 12/1965 | Rosensweig . | |
| 3,252,191 | 5/1966 | Mezerenyi et al. . | |
| 3,967,347 | 7/1976 | Bickis, Sr. . | |
| 4,077,091 | 3/1978 | Liljedahl . | |
| 4,457,051 | 7/1984 | Bartolini . | |
| 5,199,140 | 4/1993 | Valiulis et al. | 24/545 |
| 5,409,198 | 4/1995 | Roick | 24/563 |
| 5,590,443 | 1/1997 | Fildan . | |

FOREIGN PATENT DOCUMENTS

| | | |
|---|---|---|
| 505530 | 5/1939 | United Kingdom . |

*Primary Examiner*—Victor N. Sakran
*Attorney, Agent, or Firm*—Longacre & White

[57] ABSTRACT

A strap take-up device for a fashion accessory that includes an elongated strap of a purse or similar bag. The take-up device receives a strap in a looped form and selectively retains the strap in a plurality of desired positions. The retaining member receives and retains the strap in its desired position without slippage by providing a unitary body defining a spring clip formed of an elongated sheet folded, at least twice, back onto itself to form at least two strap retaining passages. The spring clip is elastically deformable to allow each of the passages to expand to an open position to allow a strap to be disposed therein and contract to a closed position to frictionally retain the strap. The spring clip is spring biased to contract to the closed position. In the preferred embodiments of this invention, the spring clip takes the forms of a W-shaped or S-shaped design.

11 Claims, 3 Drawing Sheets

STRAP TAKE-UP DEVICE FOR A FASHION ACCESSORY

BACKGROUND OF THE INVENTION

1. Field of the Invention

The present invention relates to a take-up device for a fashion accessory that includes an elongated strap of a purse or any similar article that utilizes a strap. More specifically, the present invention permits a bag or series of bags to be hung at a predetermined and uniform position on a display unit by selectively changing the length of a loop of the strap. The strap take-up device includes a spring clip which receives the strap to form a loop of a particular length.

2. Description of Related Art

Purses, assorted handbags and other fashion accessories that utilize straps are often displayed in a hanging manner on a display device. Difficulty may be encountered in placing and supporting these accessories on the display device in a uniform manner. Typically, the purses, handbag or other accessory that utilizes an elongated strap overlap, become entangled and otherwise displaced on the display device. In this instance, the effectiveness of the device display is reduced when the uniformity of the handbag arrangement is disrupted.

FIGS. 1–4 illustrates a conventional device that attempts to overcome the aforementioned drawbacks. With the device 10 of FIG. 1, a strap 12 of a handbag is inserted into a slot defined between a base portion 10*a* and a raised arm 10*b*. The strap is thus effectively shortened by the device 10 in order to facilitate display of the handbag in a retail shop (see FIG. 2). FIG. 3 shows a modified design of the device 10 of FIG. 1. The device 10 of FIG. 3 is modified such that the raised arm 10*b* is cantilevered to permit attachment to the strap 12 at an intermediate portion thereof. FIG. 4 provides a side view of the device 10 shown in FIGS. 1–3 and described above.

The conventional device 10 however suffers from the drawback that it tends to slip along the longitudinal length of the strap 12. Because the purpose of the device 10 of FIGS. 1–4 is to retain the handbag at a preset height, the purpose is defeated if the strap is permitted to slip.

The need therefore exists for a retaining device which suitably retains handbags and other articles having a strap on a display device without slippage. Moreover, such an improved device must be easily applied to, adjusted and retained on the strap.

SUMMARY OF THE INVENTION

It is the object of the present invention to provide a take-up device for a fashion accessory that includes an elongated strap of a purse or similar bag. More specifically, it is the object of the present invention to permit a bag or series of bags to be hung at a predetermined and uniform position on a display unit without slippage.

The strap take-up device according to this invention receives a folded strap in a looped form and retains the strap in its desired position without slippage by providing a unitary body defining a folded ribbon like clip. In the preferred embodiments of this invention, the take-up device takes the form of a W-shaped spring clip. The strap is interwoven between portions of the spring clip to form a loop. The size of the loop may be adjusted to adjust the relative position of a purse, or other bag in relation to a supporting bar.

As will become apparent from the description to follow, the present invention may take a number of particular shapes and forms without departing from the spirit and intent of the invention which provides a novel take-up device for handbag straps that eliminates unwanted slippage.

DETAILED DESCRIPTION OF THE PREFERRED EMBODIMENTS

Figure 2:
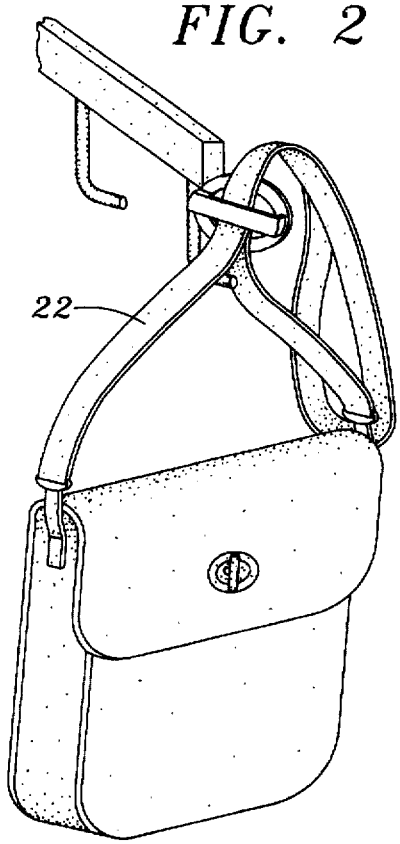
FIG. 2 illustrates a handbag utilizing the device of FIG. 1.
Figure 1:
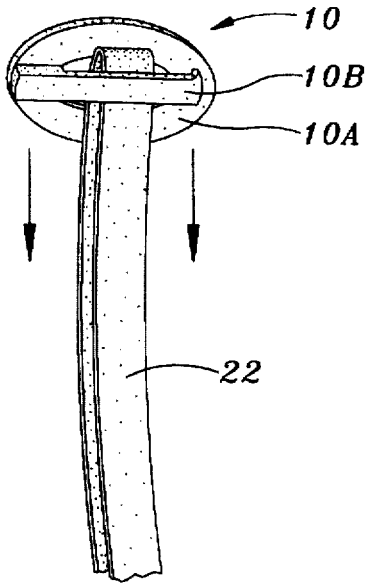
FIG. 1 illustrates a conventional strap retaining device being affix t a strap.
Figure 3:
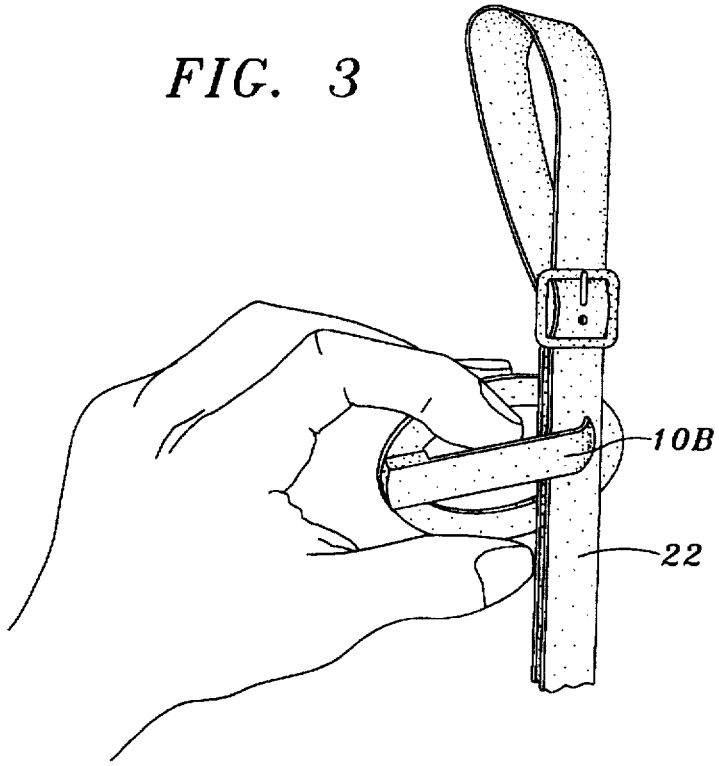
FIG. 3 illustrates another conventional retaining device being affixed to a strap.
Figure 4:
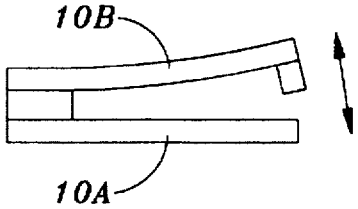
FIG. 4 is a side view of the retaining device of FIG. 3.
Figure 5:
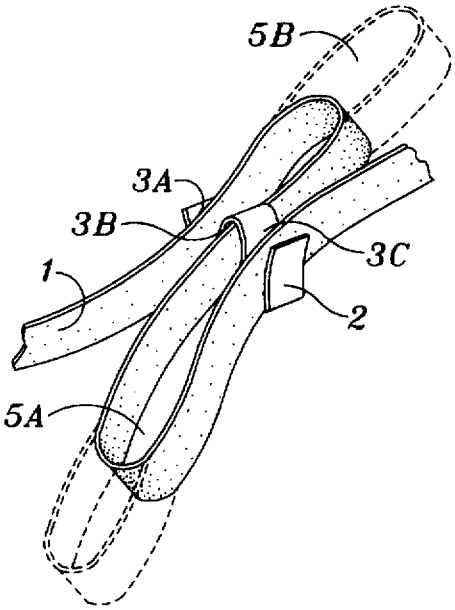
FIG. 5 illustrates a perspective view of a strap retained by the strap take-up device of the preferred embodiment.

Referring to FIG. 5, a strap 1 is retained by a strap take-up device. The strap 1 is interwoven through and between strap retaining passages 3*a*, 3*b*, and 3*c*. These strap retaining passages 3*a*, 3*b*, and 3*c* are more clearly illustrated in FIG. 8.

Figure 8:
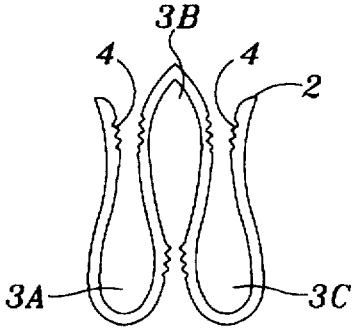
FIG. 8 illustrates a front view of the strap take-up device of the preferred embodiment.

The strap take-up device of the preferred embodiment is a spring clip 2 formed of a sheet material folded back onto itself to form at least two strap retaining passages. FIG. 8 illustrates the preferred embodiment which forms three strap retaining passages 3*a*, 3*b*, and 3*c* and is formed substantially in the shape of the letter W. The spring clip 2 is made of an elastically deformable material which will allow the retaining passages 3*a*, 3*b*, and 3*c* to expand to receive a strap 1. The spring clip 2 is spring biased to a closed position so as to selectively frictionally secure the strap 1 in a plurality of desired positions. Each through passage is formed with opposing surfaces with corresponding opposing corrugations 4 formed on each of these surfaces. The corrugations, 4 or grooves, facilitate the frictional retention of the strap 1.

As can be seen by FIG. 5, the strap 1 may form loops 5*a*, and 5*b*. The length of these loops may vary to any of a desired length by simply pulling the strap 1 through the retaining passages 3*a*, 3*b*, and 3*c* until a desired loop length is reached. The spring clip 2, will then retain the strap 1 in place thus securing the strap with the desired loops 5*a*, and 5*b*. The loops 5*a*, and 5*b* may of course be of dramatically different lengths.

Figure 7:
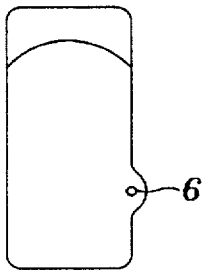
FIG. 7 illustrates a side view of the strap take-up device of the preferred embodiment.

FIG. 7 represents a side view of the spring clip of FIGS. 5 and 8. A hole 6 is formed in a portion of the spring clip to facilitate the retention of a price tag or other type of label. A plastic tag holder may be secured to the spring clip 2, through the hole 6 by any suitable means commonly known within the art.

Figure 6:
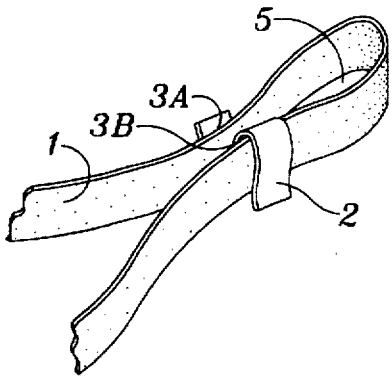
FIG. 6 illustrates a perspective view of a strap retained by the strap take-up device of an alternative embodiment.

FIG. 6 illustrates a strap 1 retained in a spring clip 2 in an alternative embodiment of the claimed invention. In this embodiment, the spring clip 2 is formed substantially in the shape of the letter S. As demonstrated by FIG. 10, the spring clip 2 is turned back onto itself twice to form two retaining passages 3*a*, and 3*b*. Corrugations, or grooves, 4 are formed on opposing internal surfaces of the retaining passages 3*a*, and 3*b*. These corrugations facilitate the retention of the strap 1. The size of the loop 5 may simply adjusted by pulling the strap 1 through the retaining passages 3*a*, and 3*b* until the desired length of the loop 5 is achieved. Once the desired length of loop 5 is achieved, the spring clip 2 will retain the strap to maintain the length of the loop 5.

Figure 9:
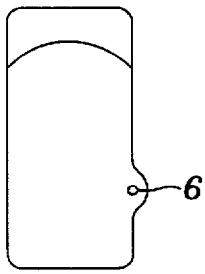
FIG. 9 illustrates a side view of the strap take-up device of an alternative embodiment.
Figure 10:
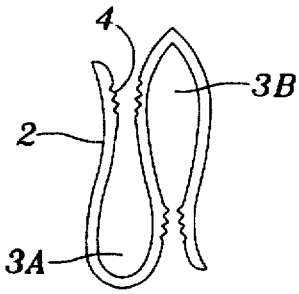
FIG. 10 illustrates a front view of the strap take-up device of alternative embodiment.
Figure 11:
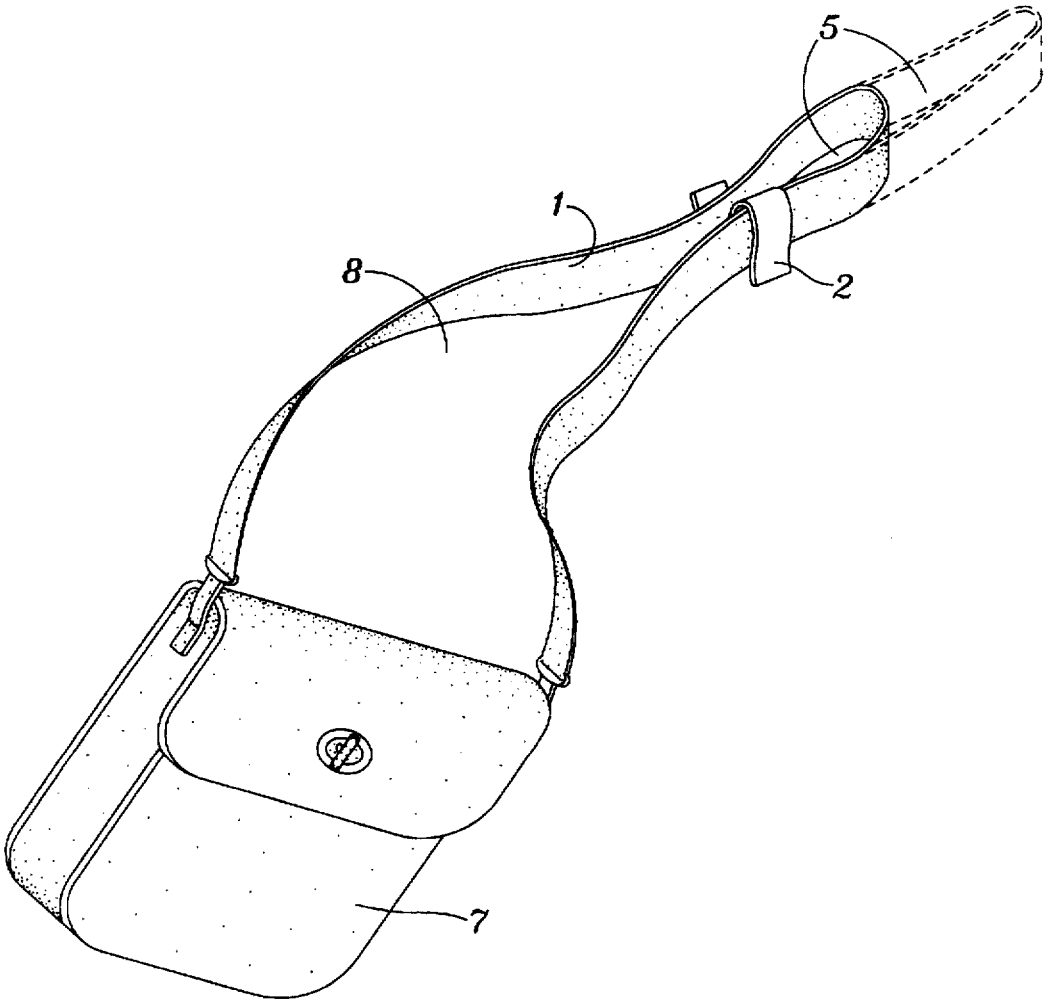
FIG. 11 illustrates a perspective view of a handbag strap and the take-up device of the alternative embodiment.

FIG. 11 illustrates the spring clip 2 of FIGS. 6, 9, and 10, retaining the strap 1, of a conventional purse 7. The strap 1 is interwoven through the retaining passages 3*a*, and 3*b* to form loop 5. Consequently, another loop 8 will be simultaneously formed by the remainder of the strap 1 and the purse 7. As previously discussed, the length of the loop 5 may be simple adjusted. Correspondingly, the length of the loop 8 will inversely change as the size of the loop 5 is adjusted. Specifically, as loop 5 is enlarged, loop 8 will be reduced. As loop 5 is reduced loop 8 will enlarge.

Varying the lengths of loops 5 and 8 has the usefulness of adjusting the appearance of the purse 7 when placed on a display in a shop. When displaying purses, or pocketbooks, it is very common to simply place the strap 1 over a supporting bar. Many supporting bars may be provided to support many purses. Different types of purses have straps of varying lengths. Additionally, it is desirable to vary the distance from which the purse hangs from a given support bar. Therefore, it is beneficial to be able to simply adjust the length of a loop formed by the strap 1 of a purse 8. If the purse 7 is displayed by placing a supporting bar through loop 8, the purse 7 will be suspended therefrom at a distance corresponding to the length of the loop 8. Therefore, by adjusting the length of loop 5, and consequently loop 8, the purse may be positioned at varying distances from a supporting bar.

The spring clip described herein may be formed of numerous materials including but not limited to plastic and metal; the selection of the particular material would depend on its ability to elastically deform to receive a strap while having a spring bias to contract sufficiently to retain the strap therein. Recyclable material should be preferred whenever possible.

It is also noted that this invention is not limited to handbags and the like, but is intended for use with any article that utilizes a strap, i.e. binoculars, sunglasses, carrying cases for cameras or other similar articles.

While the foregoing invention has been shown and described with reference to a specific preferred embodiment, it will be understood by those possessing skill in the art that various changes and modifications may be made without departing from the spirit and scope of the invention.

What is claimed is:

1. A strap take-up device for frictionally coupling an elongated strap at a predetermined position along its length, said take-up device comprising:

a spring clip formed of an elongated sheet comprising four S-shaped sidewalls having an S-shaped configuration when viewed from a first direction, said four S-shaped sidewalls having a substantially identical S-shaped cross-section taken perpendicular to said first direction, each of said S-shaped sidewalls being integrally formed with an adjacent S-shaped sidewall to thereby define three U-shaped strap retaining passages having a U-shaped configuration when viewed from said first direction, said three U-shaped passages having a substantially identical U-shaped cross-section taken perpendicular to said first direction, said spring clip being elastically deformable to allow each of said passages to expand to an open position to allow a strap to be disposed therein and contract to a closed position to frictionally retain said strap, wherein said spring clip is spring biased to contract to said closed position.

2. The strap take-up device according to claim 1, wherein, each of said passages has opposing surfaces, said opposing surfaces having corresponding opposing corrugations formed thereon to engage a surface of said strap to facilitate retention of said strap.

3. The strap take-up device according to claim 1, wherein said spring clip is formed of plastic.

4. The strap take-up device according to claim 1, wherein said spring clip is formed of sheet metal.

5. The strap take-up device according to claim 1, wherein a portion of said spring clip includes an orifice for attaching a price tag thereto.

6. A combination of a strap take-up device and an elongated strap for supporting a handbag, said take-up device being frictionally coupled to said elongated strap at a predetermined position along its length, said take-up device comprising:

a spring clip formed of a continuous elongated sheet comprising four S-shaped sidewalls having an S-shaped configuration when viewed from a first direction, said four S-shaped sidewalls having a substantially identical S-shaped cross-section taken perpendicular to said first direction, each of said S-shaped sidewalls being integrally formed with an adjacent S-shaped sidewall to thereby define three U-shaped strap retaining passages having a U-shaped configuration when viewed from said first direction, said three U-shaped passages having a substantially identical U-shaped cross-section taken perpendicular to said first direction, said spring clip being elastically deformable to allow each of said passages to expand to an open position to allow a strap to be disposed therein and contract to a closed position to frictionally retain said strap, wherein said spring clip is spring biased to contract to said closed position, wherein said strap passes into two of said strap retaining passages along said first direction and into a middle passage of said three U-shaped passages in a second direction opposite to said first direction so as to form at least one loop, said spring clip adapted to retain said strap at various positions to selectively change a length of said loop.

7. The combination of strap take-up device and strap according to claim 6, wherein, each of said passages has opposing surfaces, said opposing surfaces having corresponding opposing corrugations formed thereon to engage a surface of said strap to facilitate retention of said strap.

8. The combination of strap take-up device and strap according to claim 7, wherein said spring clip is formed of plastic.

9. The combination of strap take-up device and strap according to claim 7, wherein said spring clip is formed of sheet metal.

10. The combination of strap take-up device and strap according to claim 6, wherein, a portion of said spring clip includes an orifice for attaching a price tag thereto.

11. The combination of strap take-up device and strap according to claim 6, wherein said strap passes into a third strap retaining passage a direction substantially parallel to said first direction so as to form a second loop, said spring clip adapted to retain said strap at various positions to independently selectively change a length of each of said loops.

* * * * *